US010077547B2

(12) United States Patent
Kashirajima et al.

(10) Patent No.: US 10,077,547 B2
(45) **Date of Patent: *Sep. 18, 2018**

(54) FLUSH TOILET

(71) Applicant: TOTO LTD., Kitakyushu-shi, Fukuoka (JP)

(72) Inventors: Shu Kashirajima, Kitakyushu (JP); Kyoji Asada, Kitakyushu (JP); Satoshi Yamakawa, Kitakyushu (JP); Kazuyoshi Mizoguchi, Kitakyushu (JP); Masaki Kitamura, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/617,937

(22) Filed: Jun. 8, 2017

(65) Prior Publication Data

US 2017/0275862 A1 Sep. 28, 2017

Related U.S. Application Data

(63) Continuation-in-part of application No. 15/068,553, filed on Mar. 12, 2016, now Pat. No. 9,702,135.

(30) Foreign Application Priority Data

Mar. 18, 2015 (JP) ..... 2015-054761

(51) Int. Cl.
*E03D 5/01* (2006.01)
*E03D 11/08* (2006.01)
(Continued)

(52) U.S. Cl.
CPC ..... *E03D 5/01* (2013.01); *E03D 11/06* (2013.01); *E03D 11/08* (2013.01); *E03D 11/13* (2013.01); *E03D 1/26* (2013.01); *E03D 2201/40* (2013.01)

(58) Field of Classification Search
CPC ..... E03D 11/02
(Continued)

(56) References Cited

U.S. PATENT DOCUMENTS 9,702,135 B2 * 7/2017 Kashirajima ..... E03D 1/00

FOREIGN PATENT DOCUMENTS

JP 2002097702 4/2002
JP 2008174944 7/2008

OTHER PUBLICATIONS

Chinese Office Action for Application No. CN 20160003789.5, dated Nov. 16, 2017, 6 Pages.

* cited by examiner

*Primary Examiner* — Lori Baker
(74) *Attorney, Agent, or Firm* — Brooks Kushman P.C.

(57) ABSTRACT

A flush toilet wherein the rim inside wall portion comprises a rim inside wall upper sloped surface, and an improvement in user visibility and user rim portion cleanability is sought, flush water can be constrained from splashing outside the bowl portion by traveling by centrifugal force along the rim inside wall upper sloped surface from the inside surface formed at a relatively low height. The rim portion of the flush toilet of the invention includes a rim inside wall portion; the rim inside wall portion comprises a rim inside wall upper sloped surface, and an inside surface vertically extending straight up to the rim inside wall upper sloped surface; and the water supply apparatus comprises a constant
(Continued)

flow rate valve for spouting a predetermined constant flow rate of flush water from the water spouting portion.

9 Claims, 8 Drawing Sheets

(51) Int. Cl.
*E03D 11/06* (2006.01)
*E03D 11/13* (2006.01)
*E03D 1/26* (2006.01)

(58) Field of Classification Search
USPC ..... 4/300–442, 420–420.5
See application file for complete search history.

FLUSH TOILET

CROSS-REFERENCE TO RELATED APPLICATIONS

This application is a continuation-in-part of U.S. application Ser. No. 15/068,553 filed Mar. 12, 2016 which claims priority to JP application JP 2015-054761 filed on, Mar. 18, 2015, the disclosure of which is incorporated in its entirety by reference herein.

TECHNICAL FIELD

The present invention pertains to a flush toilet, and more particularly to a flush toilet for flushing the toilet main unit with flush water supplied from a flush water source to discharge waste.

BACKGROUND

For some time, as set forth in Patent Document 1 (Japanese Published Unexamined Patent Application 2013-44178), flush toilets have been known wherein in a wash-down type of flush toilet wherein a gravity feed storage tank is disposed as a water supply apparatus at the rear top portion of a flush toilet, the inside perimeter surface of the rim portion is formed to rise in an essentially plumb direction, and flush water is spouted from a rim spout port formed in the front region, to perform a flush as it circulates over the interior of the bowl portion.

SUMMARY

Technical Pro Such flush toilets presented the concern that in cases where a gravity fed storage tank is not used, and a direct pressure-type of water supply apparatus is applied in which a direct connection is made to a utility water supply or the like supplying water using the utility water pressure, flush water with an instantaneously high flow rate pressurized by the direct pressure of the utility could be spouted from the rim spout port, surpassing the inside perimeter surface of the rim portion formed to rise in an essentially vertical direction so as to splash outside the toilet. Therefore in the past when seeking to form the inside perimeter surface of the rim portion in an essentially vertical direction, only gravity-fed supply-type storage tanks, unaffected by water pressure fluctuations, were used.

To solve such problems, investigations have been made into constraining the splashing of water outside the toilet beyond the rim portion inside perimeter surface even when flush water at a relatively high flow rate is spouted from the rim spout port, by forming an overhang shape overhanging the rim portion inside perimeter surface so that the top portion thereof faces inward.

With respect to the rim portion of the toilet main unit, on the other hand, investigations have been conducted into flush toilets with improved user cleanability of the rim portion by adopting a shape for the rim portion achieved by significantly rounding the corner of the inside perimeter surface of the rim top portion, making it easily cleaned by a user.

Also, investigations have been conducted into flush toilets in which, by forming the toilet main unit rim portion so that the corner on the inside perimeter surface side of the rim top portion is significantly rounded, the user perceives that the top portion of the waste receiving surface widens outward, thereby showing the bowl portion to be relatively large compared to past bowl portion of toilets, and imparting a sense of confidence regarding the ease with which a user can discharge urine into the bowl portion.

However, when seeking to adopt such a rim portion with high cleanability, a new problem arises because the top portion of the rim portion is formed to be significantly rounded, so that if the height of the rim portion inside perimeter surface is lowered and the rim portion is not formed into an overhanging shape, and the flush water spouted from the rim spout port has a relatively high instantaneous flow rate, water can easily exceed the rim portion inside perimeter surface and splash outside the toilet. When a direct pressure water supply apparatus is adopted for a flush toilet having a rim portion shape with high cleanability, this type of problem is still further manifested because the flush water spouted from the rim spout port has a high instantaneous flow rate.

The present invention therefore has the object of providing a flush toilet wherein in a flush toilet in which the rim inside wall portion comprises a rim inside wall upper sloped surface such that the inside of the upper region of the rim inside wall portion slopes downward, and an improvement in user visibility and user rim portion cleanability is sought, flush water can be constrained from splashing outside the bowl portion by traveling under centrifugal force along the rim inside wall upper sloped surface from the inside surface formed at a relatively low height.

Solution to Problem

To achieve the above-described object, the invention is a bowl portion including a bowl-shaped waste receiving surface and a rim portion formed on a top edge of the waste receiving surface; a discharge path configured to discharge waste, the discharge path has an inlet that is connected at a bottom of the bowl portion; a spout portion configured to generate a circulating current by spouting flush water to the bowl portion; a water conduit configured to supply flush water to the water spout portion; and a water supply apparatus configured to supply flush water to the water conduit; wherein the rim portion comprises a rim inside wall portion forming an inner perimeter of the rim portion, and the rim inside wall portion comprises a rim inside wall upper sloped surface and an inner side surface, the rim inside wall upper sloped surface being positioned on a top region of the rim inside wall portion and being sloped downward toward the inner side surface, the inner side surface in a vertical cross section being formed in a straight line which is sloped toward an outside of the bowl portion up to the rim inside wall upper sloped surface; and wherein the water supply apparatus comprises a constant flow rate device for spouting a constant flow rate of flush water from the water spout portion.

In the invention thus constituted in a flush toilet in which the rim inside wall portion comprises a rim inside wall upper sloped surface such that the inside of the upper region of the rim inside wall portion slopes downward, and an improvement in user visibility is sought such that the top portion of the waste receiving surface is perceived to widen outward, and improved user rim portion cleanability is sought, a rim inside upper sloped surface is formed in which the inside of the rim inside wall portion upper region slopes downward, therefore the height of the inside wall surface vertically extending straight to the rim inside wall upper sloped surface is formed to be a relatively low height.

Hence even if the height of the inside surface is formed to be relatively low, the water supply apparatus constant flow rate device is able to cause flush water to be spouted at a predetermined constant flow rate from the spout portion, flush water caused to be spouted from the water spout portion can be prevented from reaching a relatively high instantaneous flow rate, and flush water can be constrained from traveling from the inside surface formed at a relatively low height along the rim inside wall upper sloped surface and splashing outside the bowl portion by centrifugal force.

In the present invention the rim portion preferably comprises a rim top surface portion forming the top surface of this rim portion, and a rim outside wall portion forming the outer perimeter of the rim portion; the rim outside wall portion comprises a rim outside wall upper sloped surface wherein the outside of the rim outside wall portion upper region slopes downward; and the horizontal distance between the upper end of the rim inside wall upper sloped surface and the lower end of the rim inside wall upper sloped surface is longer than the horizontal distance between the upper end of the rim outside wall upper sloped surface and the lower end of the rim outside wall upper sloped surface.

In the invention thus constituted in a flush toilet wherein the horizontal distance between the upper end of the rim inside wall upper sloped surface and the lower end of the rim inside wall upper sloped surface is longer than the horizontal distance between the upper end of the rim outside wall upper sloped surface and the lower end of the rim outside wall upper sloped surface, and improved user visibility such that the top portion of the waste receiving surface is perceived to widen outward and improved user rim portion cleanability are sought, out of the rim inside wall portion, a rim inside upper sloped surface is formed in which the inside of the rim inside wall portion upper region slopes downward, and the height of the inside wall surface vertically extending straight to the rim inside wall upper sloped surface is formed at a relatively low height.

Therefore even when the height of the inside surface is formed at a relatively low height, the water supply apparatus constant flow rate device is able to cause flush water to be spouted at a predetermined constant flow rate from the spout portion, flush water caused to be spouted from the water spout portion can be prevented from reaching a relatively high instantaneous flow rate, and flush water can be constrained from traveling under centrifugal force from the inside surface formed at a relatively low height along the rim inside wall upper sloped surface, and splashing outside the bowl portion.

In the present invention the rim inside wall upper sloped surface is preferably formed in an arc shape.

In the invention thus constituted the rim inside wall upper sloped surface is relatively easily formed. Moreover, when a user wipes clean a rim portion, the rim portion rim top surface portion and the rim inside wall upper sloped surface and inside surface can be efficiently cleaned with the user's own hand placed on the vertical wall to follow from the rim portion rim top surface portion to the arc shape of the rim inside wall upper sloped surface.

In the present invention a bottom edge of the rim inside wall upper sloped surface is preferably disposed above a top surface of the water spout portion.

In the invention thus constituted the flush water from the water spout portion circulates along a region below the bottom end of the rim inside wall upper sloped surface, therefore the flush water can be constrained from exceeding the rim inside wall upper sloped surface and splashing outside the toilet. Because flush water is circulated in this manner along an area below the bottom end of the rim inside wall upper sloped surface, the width and size, etc. of the rim inside wall upper sloped surface can be formed to be relatively large.

In the present invention the rim outside wall upper sloped surface is preferably formed in an arc shape; furthermore a ratio between the radius of the arc forming the rim outside wall upper sloped surface and the radius of the arc forming the rim inside wall upper sloped surface is formed to be within a ratio range of 1:2 to 1:5.

In the invention thus constituted the radius of the arc forming the rim inside wall upper sloped surface is formed to be a radius easily grasped by a user's hand. It is therefore easy for the user's own hand to follow the arc shape forming the rim inside wall upper sloped surface when wiping clean the rim portion.

In the present invention the rim inside wall upper sloped surface is preferably formed such that the vertical distance between the upper end of the rim inside wall upper sloped surface and the lower end of the rim inside wall upper sloped surface is 10% to 60% of the vertical distance between the upper end of the rim inside wall portion and the lower end of the rim inside wall portion.

In the invention thus constituted the vertical distance between the upper end of the rim inside wall upper sloped surface and the lower end of the rim inside wall upper sloped surface is 10% to 60% of the vertical distance between the upper end of the rim inside wall portion and the lower end of the rim inside wall portion, therefore of the rim inside wall portion, the height of the inside surface extending straight in the vertical direction up to the upper sloped surface is formed to be relatively low.

Thus even if the height of the inside surface is formed to be relatively low, the water supply apparatus constant flow rate device is able to cause flush water to be spouted at a predetermined constant flow rate from the spout portion, flush water caused to be spouted from the water spout portion can be prevented from reaching a relatively high instantaneous flow rate, and flush water can be constrained from traveling under centrifugal force from the inside surface formed at a relatively low height along the upper sloped surface and splashing outside the bowl.

In the present invention the rim inside wall upper sloped surface is preferably configured to have an arc whose radius is between 10 mm and 30 mm inclusive.

In the invention thus constituted the rim inside wall upper sloped surface is preferably configured to have an arc whose radius is between 10 mm and 30 mm inclusive, therefore of the rim inside wall portion, the inside wall surface extending vertically straight to the upper sloped surface is formed at a relatively low height.

Thus even if the height of the inside surface is formed to be relatively low, the water supply apparatus constant flow rate device is able to cause flush water to be spouted at a predetermined constant flow rate from the spout portion, flush water caused to be spouted from the water spout portion can be prevented from reaching a relatively high instantaneous flow rate, and flush water can be constrained from traveling under centrifugal force from the inside surface formed at a relatively low height along the upper sloped surface and splashing outside the bowl.

In the present invention the constant flow rate device preferably has a constant flow rate valve.

In the invention thus constituted the constant flow rate device for causing a predetermined constant flow rate of flush water to spout from the water spout portion is relatively easily formed by a constant flow rate valve.

In the present invention, the constant flow rate device preferably has a pump.

In the invention thus constituted the constant flow rate device for causing a predetermined constant flow rate of flush water to spout from the water spout portion is relatively easily formed by a pump.

Advantageous Effects of Invention

Using the flush toilet of the present invention, in a flush toilet wherein the rim inside wall portion comprises a rim inside wall upper sloped surface such that the inside of the upper region of the rim inside wall portion slopes downward, and an improvement in user visibility such that the top portion of the waste receiving surface is perceived to widen outward, and an improvement in user rim portion cleanability are sought, flush water can be constrained from splashing outside the bowl portion by traveling under centrifugal force along the rim inside wall upper sloped surface from the inside surface formed at a relatively low height.

DETAILED DESCRIPTION

Next, referring to the attached figures, we explain a flush toilet according to embodiments of the invention.

Figure 1:
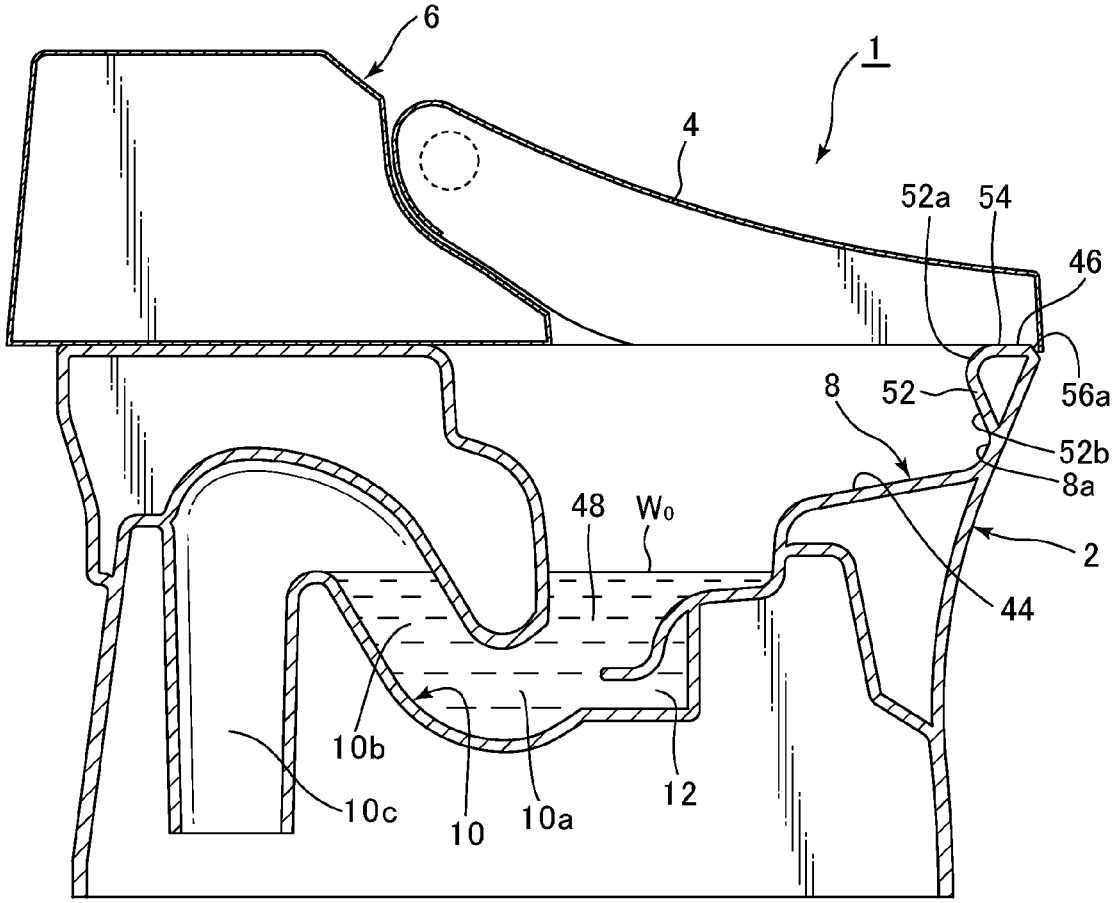
FIG. 1 is a partial cross section showing the flush toilet water supply apparatus and cover according to a first embodiment of the invention, seen from the side, and showing the interior of the toilet main unit along a center cross section.
Figure 2:
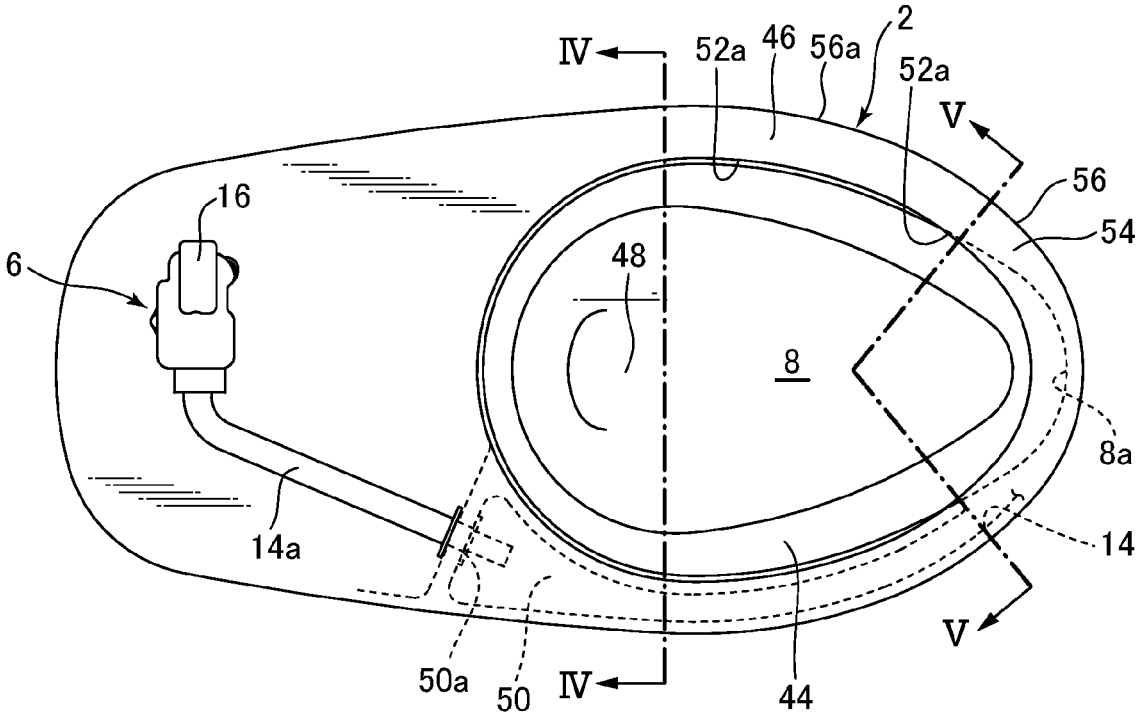
FIG. 2 is a summary plan view showing a part of the cover and water supply apparatus removed in a flush toilet according to a first embodiment of the invention.
Figure 3:
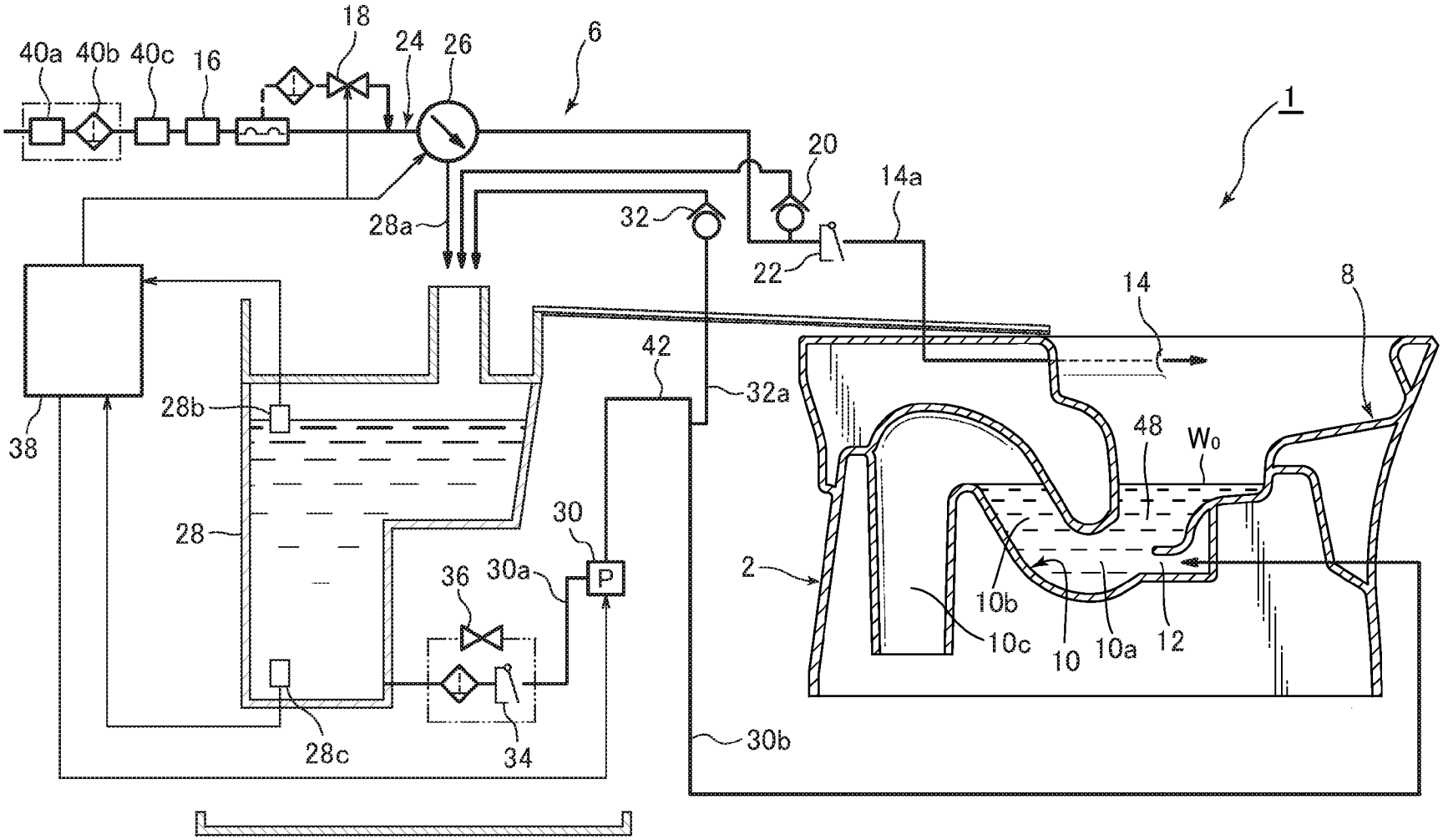
FIG. 3 is an overview schematic showing a flush toilet according to a first embodiment of the invention.

First, referring to FIGS. 1 through 3, we explain the structure of a flush toilet according to a first embodiment of the invention. Here FIG. 1 shows the state in which the water supply apparatus and cover of a flush toilet according to a first embodiment of the invention are seen from the side, and is a partial cross section showing the inside of the flush toilet along a center cross section; FIG. 2 is a summary plan view showing the state in which a part of the cover and the water supply apparatus have been removed in a flush toilet according to a first embodiment of the invention; and FIG. 3 is an overview schematic showing a flush toilet according to a first embodiment of the invention.

As shown in FIGS. 1 and 2, a flush toilet 1 according to a first embodiment of the invention comprises: a toilet main unit 2, a toilet seat (not shown) disposed on the top surface of this toilet main unit 2, a cover 4 disposed to cover the toilet seat, and a water supply apparatus 6 disposed at the rear of the toilet main unit 2.

Toilet main unit 2 is made of porcelain; a bowl portion 8 for receiving waste, a discharge trap pipe 10 (discharge path) extending from the bottom portion of this bowl portion 8, a jet spout port 12 for performing jet spouting, and a single rim spout port 14 (water spout portion) for rim spouting are formed on the toilet main unit 2.

The jet spout port 12 is formed at the bottom of the bowl portion 8; it is disposed essentially horizontally, oriented toward the inlet of the discharge trap conduit 10, and spouts flush water toward the discharge trap conduit 10.

The rim spout port 14 is formed to the front of the left side top portion of the bowl portion 8, and spouts flush water along the edge of the bowl portion 8.

Note that in the present embodiment a jet spout port 12 is formed on the toilet main unit 2, but the invention is not limited to such embodiments; it is also acceptable, for example, to form only the rim spout port of the jet spout port and the rim spout port, not forming the jet spout port.

The discharge trap conduit 10 is made up of an inlet portion 10*a*, a trap ascending pipe 10*b* rising from the inlet portion 10*a*, and a trap descending pipe 10*c* descending from this trap ascending pipe 10*b*.

A flush toilet 1 according to the first embodiment is directly connected to a utility supplying flush water, and flush water is spouted from the rim spout port 14 using the utility water supply pressure. With regard to jet spouting, as described below, flush water stored in a storage tank 28 built into the water supply apparatus 6 is pressurized by the pressurizing pump 30, and is spouted from the jet spout port 12 at a high flow rate.

The flush toilet 1 in the present embodiment is a hybrid type of flush toilet in which, for rim spouting, water is supplied and the toilet flushed using utility water pressure (direct pressure); with respect to jet spouting there is furthermore a hybrid type of water supply apparatus (utility direct pressure type+tank supply type) wherein flush water stored in the storage tank 28 is pressurized by the pressurizing pump 30 and spouted from the jet spout port 12.

Note that the flush toilet 1 water supply apparatus 6 can also be applied to non-hybrid type water supply apparatuses. For example, a utility direct pressure type of flush toilet comprising only a utility direct pressure type of water supply apparatus wherein water is supplied using utility water pressure, or a flush toilet in which water is supplied by a flush valve system, or by using supplementary pump pressure, is also acceptable. A water supply apparatus of the type wherein flush water is supplied to the toilet using an accumulator or the like is also acceptable.

If water is supplied using the utility water pressure for the rim spout water (utility direct pressure), the flow rate of rim spouted flush water under utility pressure will generally be a relatively high flow rate (relatively high instantaneous flow rate).

Next, referring to FIG. 3, we explain details of the water supply apparatus 6 in a flush toilet 1 of the first embodiment.

As shown in FIG. 3, a constant flow rate valve (constant flow rate device) 16, electromagnetic valve 18, rim spout vacuum breaker 20 for preventing reverse flow, and rim spout flapper valve 22 for preventing reverse flow are disposed on the water supply apparatus 6. In addition, a switching valve 26 for switching between supplying water to the tank and rim spouting, a water storage tank 28, a pressurizing pump 30, a vacuum breaker 32 for jet spouting, a flapper valve 34 for jet spouting, and a water drain 36 are built into the water supply path 24. Also, a controller 38 for controlling the opening and closing operation of the electromagnetic valve 18, the switching operation of the switching valve 26, and the rpm and activation time, etc. of the pressurizing pump 30 is built into the water supply apparatus 6. By at least a part of such a constitution, the water supply apparatus 6 can function as a water supply apparatus for supplying flush water to the toilet main unit 2.

The constant flow rate valve (the predetermined flow rate valve) 16 can control the inflowing flush water to a predetermined flow rate (instantaneous flow rate) or below by a stop cock 40*a*, a strainer 40*b*, and a splitter 40*c*. In the present embodiment, this constant flow rate valve 16 is arranged to control the flush water flow rate (instantaneous flow rate) between 10 liters/minute or greater and 20 liters/minute or less, for example, and more preferably to between 12 liters/minute or greater and 16 liters/minute or less. Thus the constant flow rate valve 16 controls the flow rate of flush water spouted from the rim spout port 14 to a predetermined instantaneous flow rate when the flush water flow rate has increased. Also, the constant flow rate valve 16 is capable of maintaining a predetermined instantaneous flow rate or greater when the flush water instantaneous flow rate drops. Therefore if the flush water instantaneous flow rate fluctuates, the constant flow rate valve 16 can maintain the flow rate of flush water supplied within a range at or above a predetermined instantaneous flow rate and at or below a predetermined instantaneous flow rate.

Flush water which has passed through the constant flow rate valve 16 flows into the electromagnetic valve 18, and flush water which has passed through the electromagnetic valve 18 is supplied to the rim spout port 14 or the water storage tank 28 using the switching valve 26. This switching valve 26 is capable of supplying flush water to both the rim side supply path 14*a* on the rim side and the water storage tank 28 on the tank side at the same timing, and of changing the supply proportions water to the rim side and the tank side.

The electromagnetic valve 18 is opened and closed by a control signal from the controller 38, and causes supplied flush water to flow into the switching valve 26, or stops causes it to stop.

The switching valve 26 is switched by a controller 38 control signal, and causes flush water flowing in through the electromagnetic valve 18 to be spouted from the rim spout port 14, or to flow into the water storage tank 28.

The water storage tank 28 is constituted to store flush water for spouting from the jet spout port 12. Note that in the present embodiment the water storage tank 28 has an approximately 2.5 liter internal capacity.

A top end float switch 28*b* and a bottom end float switch 28*c* are disposed on the interior of the water storage tank 28, and are able to detect the water level inside the water storage tank 28. When the water level inside the water storage tank 28 reaches a predetermined stored water level, the top end float switch 28*b* switches on, and the controller 38 senses this and closes the electromagnetic valve 18. On the other hand when the water level inside the water storage tank 28 drops to a predetermined water level, the bottom end float switch 28*c* turns on, and the controller 38 detects this and turns off the pressurizing pump 30.

The pressurizing pump 30 pressurizes flush water stored in the water storage tank 28, causing it to be spouted from the jet spout port 12. The pressurizing pump 30 is connected by a flush water conduit 30*a* extending from the lower portion of the water storage tank 28, and pressurizes flush water stored in the water storage tank 28.

Note that in the present embodiment the pressurizing pump 30 pressurizes flush water in the water storage tank 28 and causes flush water to be spouted from the jet spout port 12 at a maximum flow rate of 120 liters/minute.

Also, a flapper valve 34 for jet spouting, being a check valve, and a water drain 36 are provided midway along the flush water conduit 30*a*.

On the other hand, the outflow port of the pressurizing pump 30 is connected to the jet spout port 12 at the bottom portion of the bowl portion 8 through a flush water conduit 30*b*.

The vacuum breaker 32 for jet spouting is connected to the branch conduit 32*a* which branches from the downstream side of the pressurizing pump 30 and the flush water conduit apex portion 42, preventing the reverse flow of pooled water inside the bowl portion 8 to the water storage tank 28 side, and partitioning between same.

The controller 38 sequentially activates the electromagnetic valve 18, switching valve 26 and pressurizing pump 30 through user manipulation of a toilet flush switch (not shown), and sequentially starts spouting from the rim spout port 14 and the jet spout port 12 to flush the bowl portion 8. In addition, after completion of a flush the controller 38 releases the electromagnetic valve 18, switching the switching valve 26 to the water storage tank 28 side and replenishing flush water to the water storage tank 28. When the water level inside the water storage tank 28 rises and the top end float switch 28*b* detects a specified stored water amount, the controller 38 closes the electromagnetic valve 18 and stops the supply of water.

Once again we explain each part of the toilet main unit 2.

The bowl portion 8 comprises a waste receiving surface 44 formed in a bowl shape, and a rim portion 46 formed on the top outer side of the entire perimeter of the bowl portion 8, forming the top portion edge of the toilet main unit 2. Also, a pooled water portion 48 is formed at the bottom of the bowl portion 8. In the pooled water portion 48, flush water is accumulated up to a predetermined amount after each flushing, and a pooled water surface W0 is formed. The above-described discharge trap conduit 10 inlet portion 10*a* is opened at the bottom of this pooled water portion 48, and the bottom end of the discharge trap conduit 10 trap descending pipe 10*c* is connected to a discharge pipe (not shown) under the floor though a discharge socket (not shown).

The sheet portion 50 extends forward from the inlet portion 50*a* connected to the rim side supply path 14*a* extending from the water supply apparatus 6, and communicates in a forward orientation with the rim spout port 14 on the left side in the front side region of the bowl portion 8, which is the front side relative to a center line extending in the left-right direction, equally dividing in two the bowl portion 8 in the front-to-back direction. The rim spout port 14 spouts flush water forward from the front region of the bowl portion 8, forming a flow toward the front end of the bowl portion 8, and also forming a flow which reverses from the front end 8*a* of the bowl portion 8 toward the rear side.

Flush water spouted from the rim spout port 14 is spouted and circulated in the front direction of the toilet from the rim spout port 14 onto the surface between the rim portion 46 and the waste receiving surface 44, and onto the inside surface 52*b* of the rim portion 46, and a falling current is formed so that this circulating current flows down as it circulates from the inside surface 52*b* of the rim portion 46 in the direction of the pooled water portion 48 on the waste receiving surface 44.

Next, referring to FIGS. 1 through 6, we explain details of the above-described rim portion 46.

Figure 4:
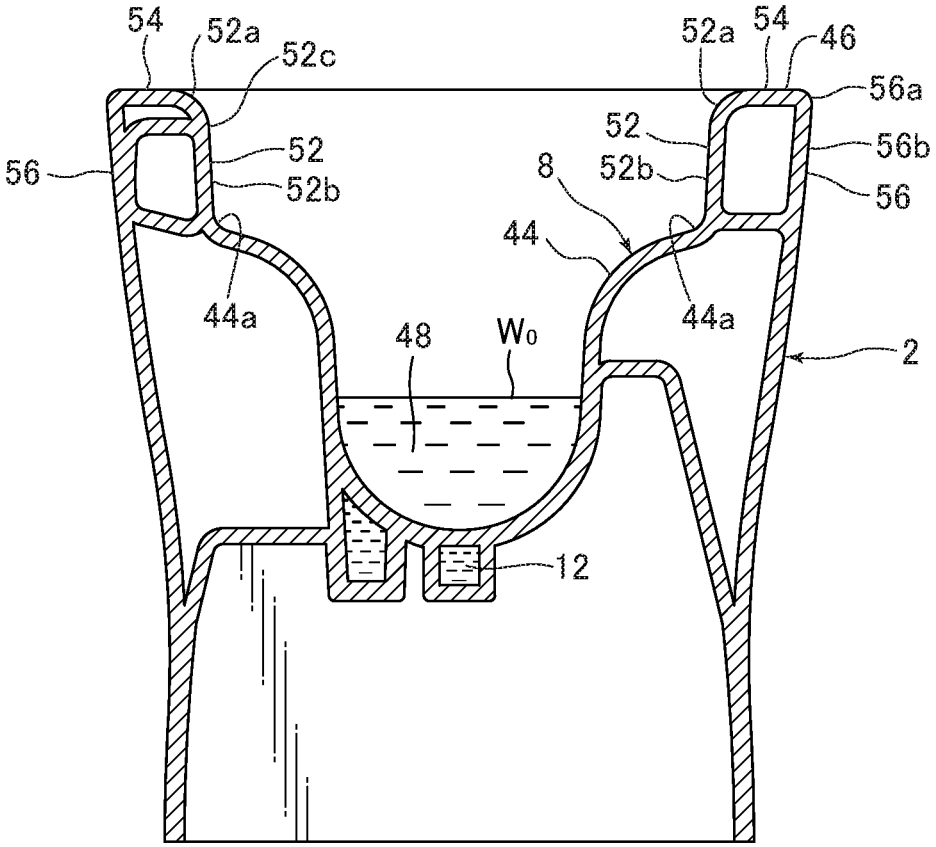
FIG. 4 is a cross section seen along line IV-IV of FIG. 2.
Figure 5:
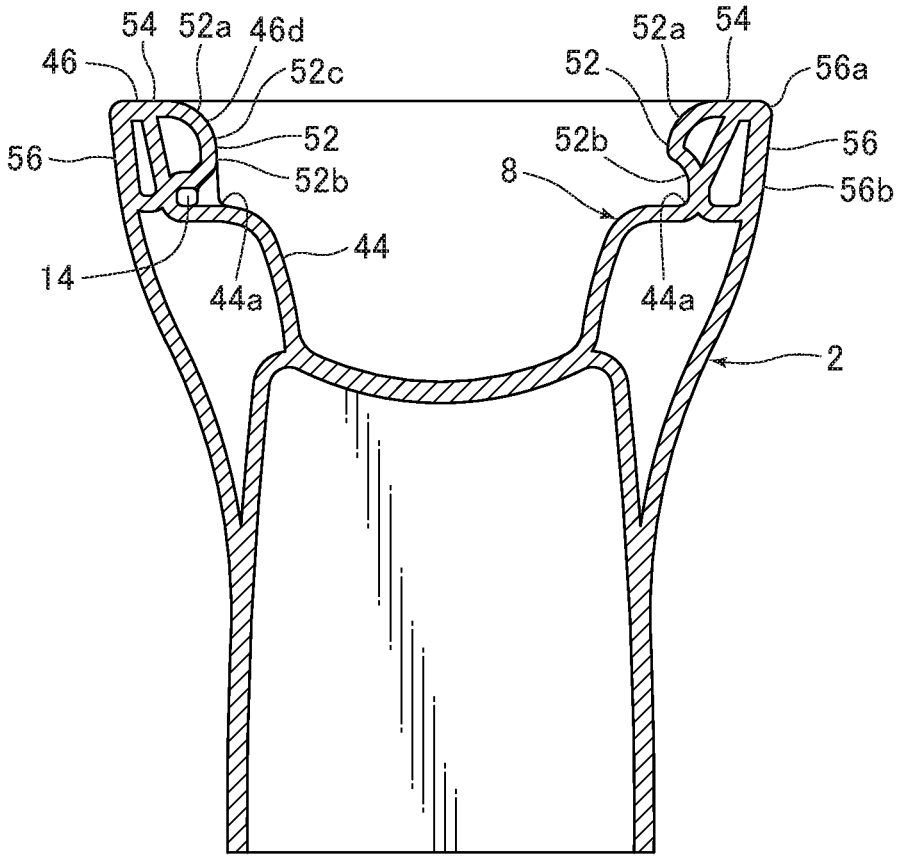
FIG. 5 is a cross section seen along line V-V of FIG. 2.
Figure 6:
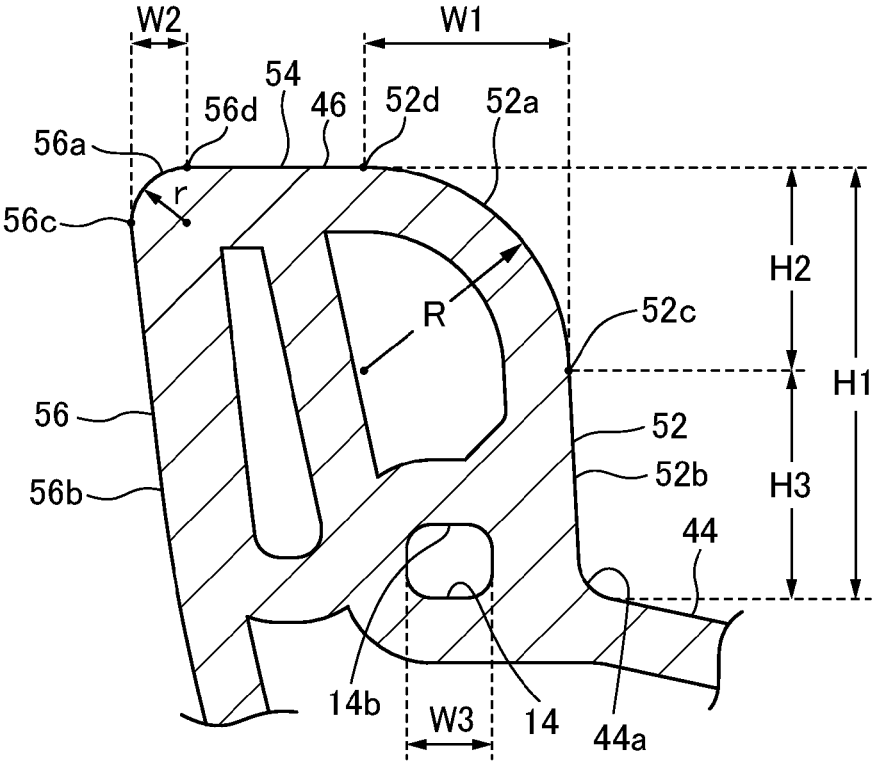
FIG. 6 is a summary expanded cross section showing an expanded view of the rim portion close to the rim spout port of a flush toilet according to a first embodiment of the invention.

FIG. 4 is a cross section seen along line IV-IV in FIG. 2; FIG. 5 is a cross section seen along live V-V in FIG. 2; FIG. 6 is summary expanded cross section showing an expanded view of the rim portion close to the rim spout port of a flush toilet according to a first embodiment of the invention.

The rim portion 46 comprises: a rim inside wall portion 52 which forms the inside perimeter surface of the rim portion 46 and is formed in a standing wall shape rising from the top end 44*a* of the waste receiving surface 44 to the apex portion of the toilet main unit 2, a rim upper surface portion 54 forming the top surface of this rim portion 46, and a rim outside wall portion 56 forming the outside perimeter surface of the rim portion 46, and formed in a standing wall shape rising up the outside surface of the toilet main unit 2 up to the rim upper surface portion 54.

The rim inside wall portion 52 comprises a rim inside wall upper sloped surface 52*a* in which the inside (the waste receiving surface 44 side) of the upper region of the rim inside wall portion 52 slopes downward, and an inside surface 52*b* forming a wall surface extending vertically straight to the rim inside wall upper sloped surface 52*a*.

The rim inside wall portion 52 is formed over the entire perimeter on the inside of the rim portion 46. The inside surface 52*b* is formed to rise essentially vertically in the majority of regions, but in a part of the front-side region from the rim spout port 14 on the bowl portion 8 out of the rim inside wall portion 52, the flow speed of flush water spouted from the rim spout port 14 is in a relatively fast region, so the top portion of the inside surface 52*b* and the rim inside wall upper sloped surface 52*a* are formed in a shape which overhangs toward the inside of the bowl portion 8. In the region from the bowl portion 8 rim spout port 14, except for a part of the front side, the flow speed of flush water spouted from the rim spout port 14 becomes relatively slow, therefore the top portion of the inside surface 52*b* and the rim inside wall upper sloped surface 52*a* have an overhanging shape. For example, out of the entire perimeter of the inside of the rim portion 46, the rim inside wall upper sloped surface 52*a* may also be formed in the part visible to a user who has lifted the seat (the part in front of the water supply apparatus 6).

From the waste receiving surface 44 top end 44*a* to the rim inside wall upper sloped surface 52*a* bottom end 52*c*, the inside surface 52*b* forms a vertically rising wall surface. For example, the inside surface 52*b* may also be a vertical wall which rises vertically from the waste receiving surface 44 top end 44*a*. More especially, as shown in FIGS. 4 and 6, the inside surface 52*b* of the rim 46 in a vertical cross section is formed in a straight line which is sloped toward an outside of the bowl portion 8 up to the rim inside wall upper sloped surface 52*a*.

The height of the rim inside wall portion 52 is formed within a relatively limited range, from the waste receiving surface 44 top end 44*a*, whose positioning also relates to the discharge pipe height, to the apex of the toilet main unit 2, whose positioning also relates to the toilet main unit 2 height. Therefore the height of the entire rim inside wall portion 52 cannot be freely changed, and is formed within a relatively limited height range. Hence in the rim inside wall portion 52 the rim inside wall upper sloped surface 52*a* is formed at the top portion thereof, hence in the remaining part thereof the height of the inside surface 52*b* rising straight up to the rim inside wall upper sloped surface 52*a* is formed at a relatively low height. For example, the height of the inside surface 52*b* is formed at a low height up to about 40% of the conventional inside surface height in the rim inside wall portion 52.

Seen in vertical cross section, the rim inside wall portion 52 rim inside wall upper sloped surface 52*a* is formed over a region with a height H2, which is within a range of 10% to 60% of the height H1 of a predetermined region from the top end to the bottom end of the rim inside wall portion 52.

Seen in vertical cross section, the rim inside wall portion 52 inside surface 52*b* is formed over a region at a height H3, which is within a range of 40% to 90% of the height H1 of a predetermined range from the top end to the bottom end of the rim inside wall portion 52.

The rim inside wall upper sloped surface 52*a* forms a sloped portion which gradually connects the corner between the horizontally oriented rim upper surface portion 54 and the vertically oriented inside surface 52*b*. The rim inside wall upper sloped surface 52*a* forms an arc shape projecting toward the center top of the bowl portion 8. I.e., it forms an arc shape connecting the rim upper surface portion 54 and the inside surface 52*b*.

The rim inside wall upper sloped surface 52*a* is formed so that its outside top end 52*d* is at the height position of the rim upper surface portion 54, and the inside of the rim inside wall upper sloped surface 52*a* slopes downward, while the top of the rim inside wall upper sloped surface 52*a* widens outward more than the bottom end 52*c* thereof. Note that the rim inside wall upper sloped surface 52*a* may also be formed with a surface shape bent to encircle the curve as a whole while including the relatively flat surface of the part between the rim upper surface portion 54 and the inside surface 52*b*.

The sloped portion gradually connecting the horizontally oriented rim upper surface portions 54 on the rim inside wall top portion sloped surfaces 52*a* with the vertically oriented inside surfaces 52*b* may also be formed by a beveled shape, diagonally cutting off the corners. I.e., the area between the rim upper surface portion 54 and the rim inside wall portion 52 may be formed of a flat surface at a predetermined angle. For example, in the vertical cross section of rim portion 46, the beveled surface may preferably form a flat surface within an angular range of 20° to 70° relative to the plumb line passing through the rim inside wall upper sloped surface 52*a* bottom end 52*c*, and more preferably may form a flat surface within an angular range of 35° to 55°. The beveled surface may also form a flat surface with a 45 degree angle relative to the plumb line passing through the bottom end 52*c* thereof.

The rim inside wall upper sloped surface 52*a* is formed in an arc shape so that the slope of a tangent to its surface changes continuously according to position. Therefore when a user places his hand to fit the rim inside wall upper sloped surface 52*a*, the occurrence of a space between his hand and the rim inside wall upper sloped surface 52*a* can be constrained, and the hand can be naturally placed to follow the entire curved surface. Note that the rim inside wall upper sloped surface 52*a* may also be formed by a curved surface of another shape to match the curve in the human hand.

Note that when the above-described user places his own hand to conform to the rim inside wall upper sloped surface 52*a*, this includes not only the hand as a whole, but also conforming the palm and fingers only. In addition, fitting of a user's hand to the rim inside wall upper sloped surface 52*a* includes cases of fitting the hand to the rim inside wall upper sloped surface 52*a* through a cleaning cloth or paper such as toilet paper for cleaning the toilet, etc. Also, fitting of a user's hand to the rim inside wall upper sloped surface 52*a* includes cases in which the user fits his hand to the rim inside wall upper sloped surface 52*a* through a cleaning cloth or the like with gloves or the like on the user's hand.

Viewed from the top plan view, a waste receiving surface 44 forming a descending curved surface as it bends toward the middle is disposed at the left-right center of the toilet main unit 2 (the transverse direction when the toilet main unit 2 is seen from the front), and a rim inside wall upper sloped surface 52*a*, the inside of which similarly forms a descending curved surface, is disposed on the outside of the waste receiving surface 44. Therefore when seen from the top plan view, a rim inside wall upper sloped surface 52*a* with a gradually inward descending curved surface connects to the outside perimeter of the waste receiving surface 44, and can thereby convey to a user the impression of forming a continuous outwardly spreading curved surface. I.e., a user can receive the impression that the waste receiving surface 44 is still further widened outward by the area of the rim inside wall upper sloped surface 52*a*. For example, in a case in which a male user urinates standing in front of the toilet main unit 2, conveying to the user the impression that the waste receiving surface 44 is wide constrains the worry that urine will miss the waste receiving surface 44, enabling the user to urinate with ease. Moreover, even in cases where a user urinates in a sitting position on the toilet main unit 2 seat (not shown), conveying to the user of the impression that the waste receiving surface 44 is wide before the toilet seat (not shown) is lowered constrains the worry that urine will miss the waste receiving surface 44, so that an impression of ease in urination can be conveyed.

As shown in FIG. 6, the bottom end 52*c* of the rim inside wall upper sloped surface 52*a* is placed above the rim spout port 14. More particularly, the bottom end 52*c* of the rim inside wall upper sloped surface 52*a* is placed above the rim spout port 14 apex 14*b*. Stated differently, the inside surface 52*b* is formed up to a height above that of the rim spout port 14 apex 14*b*. Therefore the rim spout port 14 spouts flush water so that it contacts the inside surface 52*b* on the downstream side of the near vicinity thereof.

A rim inside wall upper sloped surface 52*a* of the above type is formed in a relatively gradual arc shape, and the left-right width thereof is formed to be relatively large. The width W1 in the horizontal direction (e.g., the direction from the inside toward the outside of the toilet main unit) between the top end 52*d* and the bottom end 52*c* of the rim inside wall upper sloped surface 52*a* is formed to be larger than the left-right width W3 of the rim spout port 14 opening. The bottom end 52*c* of the rim inside wall upper sloped surface 52*a* is placed above the rim spout port 14, therefore the horizontal width W1 of the rim inside wall upper sloped surface 52*a* can be formed to be relatively large, and the vertical height H1 of the rim inside wall upper sloped surface 52*a* can be formed to be relatively large. Hence the rim inside wall upper sloped surface 52*a* can be formed to slope downward on the inside along a gradual arc shape with a large diameter.

The rim upper surface portion 54 forms a flat surface extending in the horizontal direction, and forms the peak surface of the toilet main unit 2. When seeking to clean the rim portion 46 of the toilet main unit 2, a user must clean the rim inside wall upper sloped surface 52*a* and inside surface 52*b* with the palm, etc. disposed to follow the rim upper surface portion 54 horizontally, and with fingers bent. Note that the rim upper surface portion 54 is not limited to a horizontal surface, and may also be formed as a downward sloping surface or an upward sloping surface toward the bowl portion 8. Also, the rim upper surface portion 54 may be formed by a curved surface. Moreover, the rim upper surface portion 54 may also be formed as part of a sloped surface in which the top end 52*d* of the rim inside wall upper sloped surface 52*a* is extended to the outside. For example, if the rim upper surface portion 54 is formed as a part of the rim inside wall upper sloped surface 52*a*, the top end 52*d* of the rim inside wall upper sloped surface 52*a* and the top end of the rim outside wall upper sloped surface can be relatively smoothly connected, and a rim portion 46 top surface can also be formed.

The rim outside wall portion 56 comprises: a rim outside wall upper sloped surface (rim outside edge portion) 56*a* which connects the horizontally oriented rim upper surface portion 54 and the vertically oriented rim outside wall and forms the edge of the rim portion 46 top portion (outside of the toilet main unit 2), and a rim outside wall 56*b* forming a vertical wall up to the rim outside wall upper sloped surface 56*a*.

The rim outside wall upper sloped surface 56*a* has rounded corners between the rim upper surface portion 54 and the rim outside wall, and the top end 56*d* on the inside thereof is at the height position of the rim upper surface portion 54, while the outside thereof forms a downward sloping edge portion. The rim outside wall upper sloped surface 56*a*, when seen in expanded view, forms an arc shape projecting outward and upward. I.e., it forms an arc shape connecting the rim upper surface portion 54 and the rim outside wall 56*b*.

Seen in vertical cross section, the rim outside wall upper sloped surface 56*a* is formed by an arc with a radius r of 5 mm to 8 mm. The rim inside wall upper sloped surface 52*a* when seen in vertical cross section is formed by an arc having a radius of 10 mm to 30 mm and more preferably 16 mm to 25 mm. The ratio of the radius r of the arc forming the rim outside wall upper sloped surface 56*a* to the radius R of the arch forming the rim inside wall upper sloped surface 52*a* is formed in a ratio range of 1:2 to 1:5.

The width W1 of the rim inside wall upper sloped surface 52*a* in the horizontal direction (e.g., the direction facing from the inside direction toward the outside direction of the toilet main unit) is formed to be larger than the width W2 in the horizontal direction (e.g., the direction facing from the inside direction to the outside direction of the toilet main unit) between the top end 56*d* and the bottom end 56*c* of the rim outside wall upper sloped surface 56*a*. The rim inside wall upper sloped surface 52*a* is formed by an arc with a radius of 10 mm to 30 mm, therefore when a user places his hand on the rim inside wall upper sloped surface 52*a*, the hand can be naturally placed along the rim inside wall upper sloped surface 52*a*, and an easily gripped shape can be formed without producing relatively large spaces relative to the rim portion 46.

Note that in the rim outside wall upper sloped surface 56*a*, the rounding of the surface between the rim upper surface portion 54 and the rim outside wall 56*b* may also change continuously.

I.e., in the rim outside wall upper sloped surface 56*a*, the curvature radius of the surface between the rim upper surface portion 54 and the rim outside wall 56*b* may also change continuously.

Also, in the rim inside wall upper sloped surface 52*a*, the sloped surface formed between the rim upper surface portion 54 and the inside surface 52*b* may be formed by a curved surface which continuously changes such that the sloped surface is rounded. I.e., in the rim inside wall upper sloped surface 52*a*, the curvature radius of the surface between the rim upper surface portion 54 and the inside surface 52*b* may also change continuously.

Also, as described above, in at least a part of the total perimeter of the rim portion 46, the inside surface 52*b* and the rim inside wall upper sloped surface 52*a* are formed in an overhanging shape toward the inside, and the rim portion 46 is easily gripped to enable lifting up by an installer or manufacturer with hands placed on the inside of the rim portion 46 overhanging shape. Therefore when an installer or manufacturer carries the toilet, placement of hands on the rim portion 46 formed in an overhanging shape enables the load being lifted upward to act more easily on the rim portion 46, with fingertips locked into the underside of the rim inside wall upper sloped surface 52*a*, facilitating carrying of the toilet.

Figure 7:
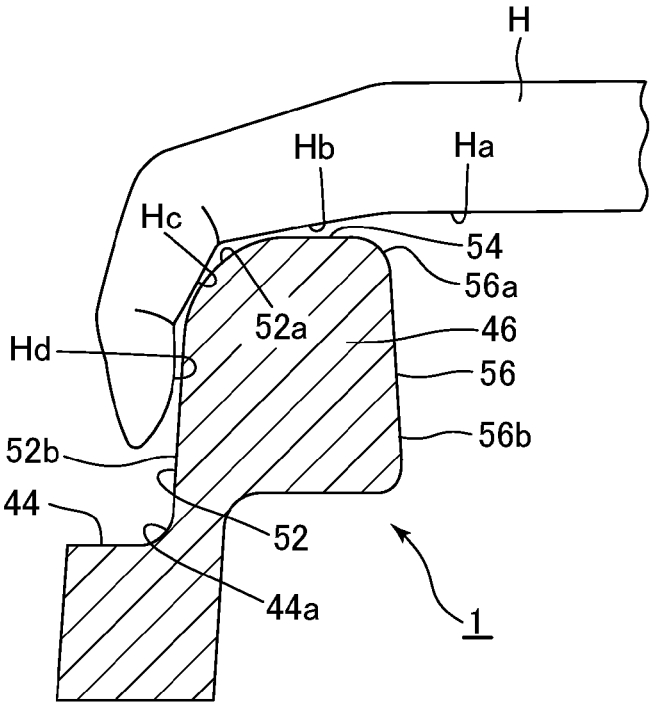
FIG. 7 is a diagram showing the state in which a user's hand is placed to follow along the rim inside wall upper sloped surface of the rim portion in a flush toilet according to a first embodiment of the invention.
Figure 8:
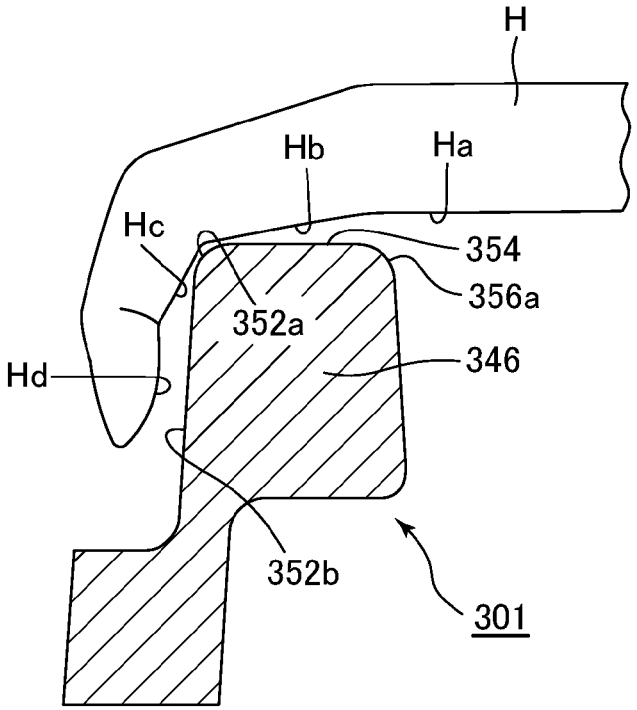
FIG. 8 is a diagram showing a user's hand placed on the rim inside wall top portion edge portion in a conventional flush toilet.

Next, referring to FIGS. 7 and 8, we explain details of the above-described state, in which a user seeks to clean the rim portion 46.

FIG. 7 is a diagram showing the state in which a user's hands are placed to follow along the rim inside wall upper sloped surface of the rim portion in a flush toilet according to a first embodiment of the invention; FIG. 8 is a diagram showing a user's hands placed on the rim inside wall top portion edge portion in a conventional flush toilet. The user's hand and fingers is denoted in this explanation by an H.

In the present embodiment, when a user seeks to clean the rim portion 46, the user cleans with his hand and fingers H positioned so that the palm Ha and/or palm side of the hand Hb contact the rim upper surface portion 54, thereby cleaning the inside surface 52*b* on the fingertip Hd side. Here the rim upper surface portion 54 forms approximately a horizontal plane, and the inside surface 52*b* forms approximately a vertical wall surface, therefore the user bends his finger joints to clean the inside surface 52*b* side. At this point the rim inside wall upper sloped surface 52*a* forms a relatively large radius arc, so the bent part of the fingers (e.g., Hc, Hd) may be bent gradually, and the bent part of the fingers (e.g., Hc) may be positioned to fit the arc in the rim inside wall upper sloped surface 52*a*. Therefore the user may, for example, efficiently clean the rim upper surface portion 54, the rim inside wall upper sloped surface 52*a*, and the inside surface 52*b* simultaneously with the palm-side part Hb on the finger joint side of the fingers in contact with the rim upper surface portion 54, the second finger joint Hc in contact with the rim inside wall upper sloped surface 52*a*, and the fingertip part Hd in contact with the inside surface 52*b*. Furthermore, the rim upper surface portion 54 and the rim inside wall upper sloped surface 52*a* and inside surface 52*b* can be placed in contact without the user excessively bending his hand and fingers H forcedly, hence the user can easily impart the necessary cleaning force to his hand and fingers H. Therefore the cleanability of the rim upper surface portion 54, the rim inside wall upper sloped surface 52*a*, and the inside surface 52*b* is improved.

This enables the prevention of instances in which not enough cleaning force can be made to act on the rim inside wall upper sloped surface 52*a*, leading to problems with cleaning the rim inside wall upper sloped surface 52*a* and requiring further cleaning work when a user seeks to clean the inside surface 52*b* from the rim upper surface portion 54 side to beyond the rim inside wall upper sloped surface 52*a*.

In response to this, as shown in FIG. 8, in a conventional flush toilet 301 a conventional rim inside wall upper edge portion 352*a* is formed in the rim portion 346. In a conventional flush toilet 301, when a user seeks to clean a rim portion 346, and the user cleans with the palm Ha of the hand H and/or the palm side part Hb of the fingers positioned to contact the rim top surface portion 354, the rim inside wall upper edge portion 352*a* forms a connecting part (edge portion) consisting of a relatively small radius arc (an arc with essentially the same radius as the rim outside wall upper sloped surface 365*a*), so that bending finger parts such as the second finger joint part Hc cannot be positioned to fit the arc of the rim inside wall upper edge portion 352*a*. I.e., the second finger joint part Hc on the user's hand H becomes separated from the rim inside wall upper edge portion 352*a*, and the fingertip part Hd is separated from the inside surface 352*b*.

To place the fingertip part Hd in contact with the inside surface 352*b* from this state requires the palm Ha and palm-side part of fingers Hb to be slightly raised to as to separate from the rim top surface portion 354.

In a conventional flush toilet 301, the limitation in the range of human finger joint mobility means that even if hypothetically the hand is excessively bent, and the user's hand H joint side part Hb is contacting the rim top surface portion 354, and the second finger joint part Hc is contacting a part of the upper portion of the rim inside wall upper edge portion 352*a*, it will not only not be possible for contact to occur between the second finger joint part Hc and the lower portion of the rim inside wall upper edge portion 352*a*, it will also not be possible for the fingertip part Hd to contact the inside surface 352*b*. Therefore problems arise with cleaning the rim inside wall upper edge portion 352*a* and the inside surface 352*b*, and even more cleaning work results.

In a conventional flush toilet 301, the limitation in the range of human finger joint mobility means that even if hypothetically the hand is excessively bent, and the user's hand H joint side part Hb is contacting the rim top surface portion 354, and the fingertip part Hd is contacting the inside surface 352*b*, it is not possible for the second finger joint part Hc and the rim inside wall upper edge portion 352*a* to be simultaneously placed in contact. Therefore problems arise with cleaning the rim inside wall upper edge portion 352*a*, and even more cleaning work results.

In addition, the rim top surface portion 354 and some other curved surfaces cannot be simultaneously placed in contact without the user excessively bending his hand H, so it is difficult for a user to impose the force required for cleaning on the hand H. Therefore problems arise with the cleanability of the rim top surface portion 354, the rim inside wall upper edge portion 352*a*, and the inside surface 352*b*.

Once again we explain a flush toilet according to an embodiment of the invention.

Thus in a flush toilet according to the above-described embodiment of the invention, the rim inside wall portion 52 comprises a rim inside wall upper sloped surface 52*a* in which the inside of the upper region of the rim inside wall portion 52 slopes downward. Therefore when a user wipes off the rim portion 46, with the user's own hand placed on the rim inside wall upper sloped surface 52*a* from the top surface of the rim portion 46 up to the inside surface 52*b* to follow the rounding of the rim inside wall upper sloped surface 52*a*, the rim upper surface portion 54, the rim inside wall upper sloped surface 52*a*, and the inside surface 52*b* can be efficiently cleaned. In addition, because wiping and cleaning can be accomplished while applying a relatively uniform force to the rim inside wall upper sloped surface 52*a* and the inside surface 52*b* from the rim upper surface portion 54 of the rim portion 46, the user can easily apply a relatively strong force to the entire rim portion being wiped and cleaned, and cleanability can be improved.

Also, the rim inside wall portion 52 comprises a rim inside wall upper sloped surface 52*a*, whereby the inside of the upper region of the rim inside wall portion 52 slopes downward. Therefore the rim inside wall upper sloped surface 52*a* formed on the upper and outer side of the waste receiving surface 44 can give the user the impression that the waste receiving surface 44 widens further outward, and the bowl portion 8 can be made to appear relatively larger than in the past, thereby imparting a feeling of ease so that the user can discharge urine more easily into the bowl portion 8 during use.

In a toilet 1 according to the above-described embodiment of the invention, wherein the rim inside wall portion 52 comprises a rim inside wall upper sloped surface 52*a* in which the inside of the upper region of the rim inside wall portion 52 slopes downward, and user visibility is improved so that the top portion of the waste receiving surface 44 is perceived to widen toward the outside, and an effort is made to improve user cleanability of the rim portion 46: a rim inside wall upper sloped surface 52*a* is formed wherein the inside of the upper region of the rim inside wall portion 52 slopes downward, therefore the height of the inside surface 52*b* extending straight in the vertical direction up to the rim inside wall upper sloped surface 52*a* is formed to be relatively low.

Therefore if the height of the inside surface is formed at a relatively low height, the constant flow rate valve 16 of the water supply apparatus 6 is able to cause flush water to be spouted at a predetermined constant flow rate from the rim spout port 14, flush water caused to be spouted from the rim spout port 14 can be prevented from reaching a relatively high instantaneous flow rate, and flush water can be constrained from traveling under centrifugal force from the inside surface 52*b* formed at a relatively low height along the rim inside wall upper sloped surface 52*a* and splashing outside the bowl portion 8.

In a toilet 1 according to the above-described embodiment of the invention, the horizontal width of the rim inside wall upper sloped surface 52*a* in which the inside of the rim inside wall portion 52 upper region slopes downward is formed to be larger than the horizontal width of the rim outside wall upper sloped surface 56*a*, and an effort is made to improve user visibility so that the top portion of the waste receiving surface 44 is perceived to widen outward, and to improve the cleanability of the rim portion 46 by the user: a rim inside wall upper sloped surface 52*a* is formed in which, of the rim inside wall portion 52, the inside of the upper region of the rim inside wall portion 52 slopes downward, therefore the height of the inside surface 52*b* extending straight in the vertical direction up to the rim inside wall upper sloped surface 52*a* is formed to be relatively low.

Therefore even if the height of the inside surface is formed to be relatively low, the constant flow rate valve 16 of the water supply apparatus 6 is able to cause flush water to be spouted at a predetermined constant flow rate from the rim spout port 14, and flush water caused to be spouted from the rim spout port 14 can be prevented from reaching a relatively high instantaneous flow rate, so that flush water is constrained from traveling under centrifugal force from the inside surface 52*b* formed at a relatively low height along the rim inside wall upper sloped surface 52*a* and splashing outside the bowl portion 8.

Also, in a flush toilet according to the above-described embodiment of the invention, the rim inside wall upper sloped surface 52*a* can be formed relatively simply. Moreover, when a user wipes off the rim portion 46, with the user's own hand placed from the rim upper surface portion 54 of the rim upper surface portion 54 up to the inside surface 52*b* so as follow the arc shape of the rim inside wall upper sloped surface 52*a*, the rim upper surface portion 54, the rim inside wall upper sloped surface 52*a*, and the inside surface 52*b* can be efficiently cleaned, and cleanability can be improved.

Also, using a flush toilet 1 according to the above-described embodiment of the invention, flush water spouted from the rim spout port 14 is circulated along a region below the bottom end 52*c* of the rim inside wall upper sloped surface 52*a*, therefore flush water can be constrained from exceeding the rim inside wall upper sloped surface 52*a* and splashing outside the toilet. Because flush water is circulated in this manner along an area below the bottom end 52*c* of the rim inside wall upper sloped surface 52*a*, the width and size, etc. of the rim inside wall upper sloped surface 52*a* can be formed to be relatively large. However, the present invention is not limited to such embodiments; for example, a similar effect can be obtained if the position of the bottom end 52*c* of the rim inside wall upper sloped surface 52*a* at the maximum height reached by flush water in the rim spout port 14 is high. For example, an arrangement is acceptable whereby if the height of flush water spouted from the rim spout port 14 reaches only the center of the rim spout port 14, the bottom end 52*c* of the rim inside wall upper sloped surface 52*a* will be at a higher position than the center of the rim spout port 14.

Also, using a flush toilet 1 according to the above-described embodiment of the invention, the radius of the arc forming the rim inside wall upper sloped surface 52*a* is formed to be a radius easily gripped by the curve in a user's hands. It is therefore easy for the user's own fingers to follow the arc shape forming the rim inside wall upper sloped surface 52*a* when a user is wiping clean the rim portion 46.

Also, in a flush toilet 1 according to the above-described embodiment of the invention, the rim inside wall upper sloped surface 52*a* is formed over a region in the range of 10% to 60% of a predetermined region from the top end 52*d* to the bottom end 52*c* of the rim inside wall portion 52, therefore of the rim inside wall portion 52, the height of the inside surface 52*b* vertically extending straight up to the rim inside wall upper sloped surface 52*a* is formed to be relatively low.

Thus even if the height of the inside surface is formed to be relatively low, the constant flow rate valve 16 of the water supply apparatus 6 is able to cause flush water to be spouted at a predetermined constant flow rate from the rim spout port 14, flush water caused to be spouted from the rim spout port 14 can be prevented from reaching a relatively high instantaneous flow rate, and flush water can be constrained from traveling by centrifugal force from the inside surface 52*b* formed at a relatively low height along the rim inside wall upper sloped surface 52*a* and splashing outside the bowl.

Also, in a flush toilet 1 according to the above-described embodiment of the invention, the radius of the arc forming the rim inside wall upper sloped surface 52*a* is formed to be in a range of 10 mm to 30 mm, therefore of the rim inside wall portion 52, the height of the inside surface 52*b* extending vertically straight to the rim inside wall upper sloped surface 52*a* is formed to be a relatively low height.

Thus even if the height of the inside surface is formed to be relatively low, the constant flow rate valve 16 of the water supply apparatus 6 is able to cause flush water to be spouted at a predetermined constant flow rate from the rim spout port 14, flush water caused to be spouted from the rim spout port 14 can be prevented from reaching a relatively high instantaneous flow rate, and flush water can be constrained from traveling by centrifugal force from the inside surface 52*b* formed at a relatively low height along the rim inside wall upper sloped surface 52*a* and splashing outside the bowl.

In the flush toilet 1 according to the above-described embodiment of the invention, the constant flow rate device for causing a predetermined constant flow rate of flush water to be spouted from the rim spout port 14 may be relatively simply formed by a constant flow rate valve 16.

Figure 9:
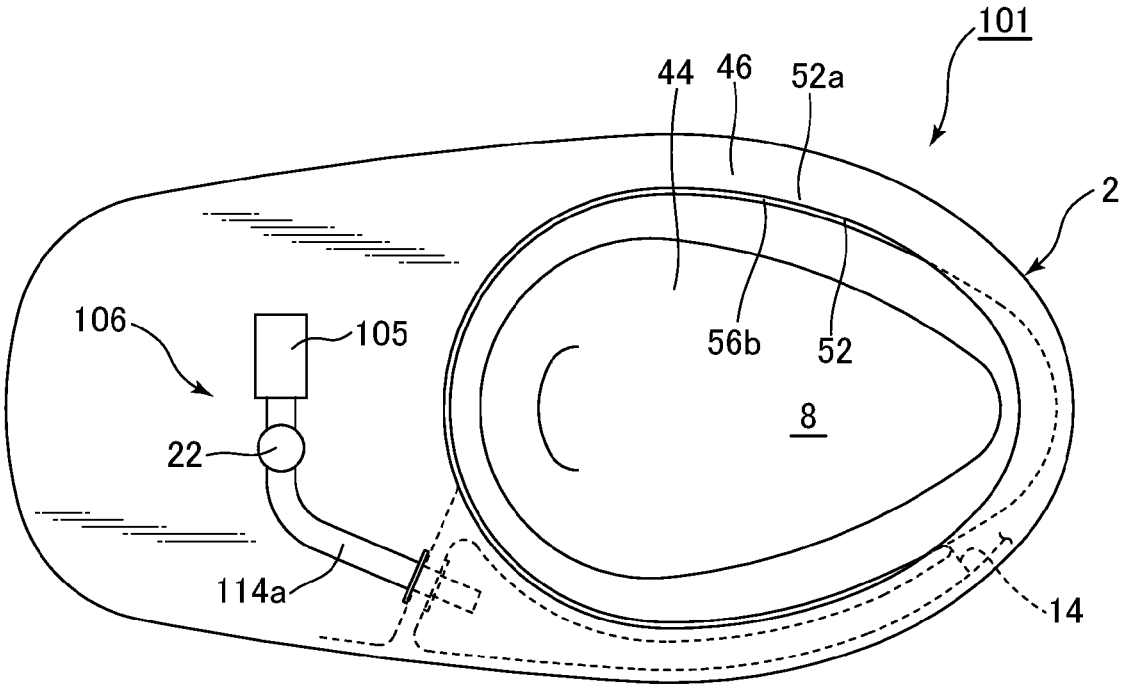
FIG. 9 is a summary plan view showing part of the cover and water supply apparatus removed in a flush toilet according to a second embodiment of the invention.

Next, referring to FIG. 9, we explain a flush toilet according to a second embodiment of the invention. The second embodiment is an example of an application to a flush toilet such that whereas rim spout water had been supplied using utility water pressure in the hybrid water supply apparatus 6 according to the first embodiment of the invention, rim spout water is supplied in the hybrid water supply apparatus 106 according to the second embodiment of the invention by pressurizing flush water supplied from a water source using the water supply pressurizing pump 105.

FIG. 9 is a summary plan view showing a part of the cover and water supply apparatus removed in a flush toilet according to a second embodiment of the invention. Because the flush toilet according to the second embodiment has essentially the same structure as the flush toilet according to the above-described first embodiment, here we will explain those parts, etc. of the second embodiment which differ from the first embodiment.

As shown in FIG. 9, a flush toilet 101 according to a second embodiment comprises a water supply apparatus 106 disposed at the back of the toilet main unit 2. In the flush toilet 101 hybrid water supply apparatus 106 according to the second embodiment, flush water which has flowed in from a water supply source such as a utility through the stop cock 40*a* is stored in a flush water tank (not shown), and flush water is discharged from the rim spout port 14 by supply pressure achieved by pressurizing (supplementing) the supply pressure of flush water in the flush water tank using the water supply pressurizing pump 105.

In the hybrid water supply apparatus 106, whereas the flush water instantaneous flow rate had been constrained to a predetermined instantaneous flow rate or below by the constant flow rate valve 16 in the flush toilet 1 water supply apparatus 6 according to the first embodiment of the invention, a flush water tank (not shown) and a water supply pressurizing pump 105 are provided in place of the constant flow rate valve 16 in the flush toilet 101 hybrid water supply apparatus 106 according to the second embodiment of the invention, and the flush water instantaneous flow rate is constrained to a predetermined instantaneous flow rate by the water supply pressurizing pump 105.

The second water supply system 214*b* has: a flush water tank for storing flush water supplied from a water source such as a utility or the like, a water supply pressurizing pump 205 capable of pressurizing flush water in the flush water tank (flush water supplied from the flush water tank) up to a water pressure within a predetermined range, and a reverse flow-preventing check valve (rim spouting flapper valve 22 or the like).

Flush water which has passed through a water supply pressurizing pump 105 is supplied to the rim spout port 14. The water supply pressurizing pump 105 can pressurize flush water and feed it at a predetermined flow rate (instantaneous flow rate) or greater, and can control the degree of pressurization to feed the flush water while controlling it to a predetermined flow rate (instantaneous flow rate) or below. In the present embodiment, this water supply pressurizing pump 105 is, for example, arranged to control the flush water flow rate (instantaneous flow rate) to 10 liters/minute or greater and 20 liters/minute or less (and more preferably from 12 liters/minute or greater to 16 liters/minute or less). Thus the water supply pressurizing pump 105 is able to control the flush water flow rate to a predetermined instantaneous flow rate or below, and is able to maintain the flush water flow rate at a predetermined instantaneous flow rate. Therefore if the flush water instantaneous flow rate fluctuates, the water supply pressurizing pump 105 can maintain the flow rate of flush water supplied within a range at or above a predetermined instantaneous flow rate and at or below a predetermined instantaneous flow rate.

As in the flush toilet 1 according to the first embodiment, in a toilet 101 according to a second embodiment of the invention, as well, the rim inside wall portion 52 comprises a rim inside wall upper sloped surface 52*a* wherein the inside of the upper region of the rim inside wall portion 52 slopes downward, and in a flush toilet 101 in which user visibility is improved so that the upper portion of the waste receiving surface 44 is perceived to widen outward, and an effort is made to improve the cleanability of rim portion 46, a rim inside wall upper sloped surface 52*a* is formed in which the inside of the rim inside wall portion 52 upper region slopes downward, therefore the height of the inside surface 52*b* vertically extending straight to the rim inside wall upper sloped surface 52*a* is formed to have a relatively low height.

Therefore even if the height of the inside surface is formed to be relatively low, the water supply apparatus 106 water supply pressurizing pump 105 is able to cause flush water to be spouted at a predetermined constant flow rate from the rim spout port 14, flush water caused to be spouted from the rim spout port 14 can be prevented from reaching a relatively high instantaneous flow rate, and flush water can be constrained from traveling under centrifugal force from the inside surface 52*b* formed at a relatively low height along the rim inside wall upper sloped surface 52*a* and splashing outside the bowl portion 8.

Also, using a flush toilet 101 according to the above-described embodiment of the invention, a constant flow rate device for spouting a predetermined constant flow rate of flush water from the rim spout port 14 can be relatively easily formed by the water supply pressurizing pump 105.

Figure 10:
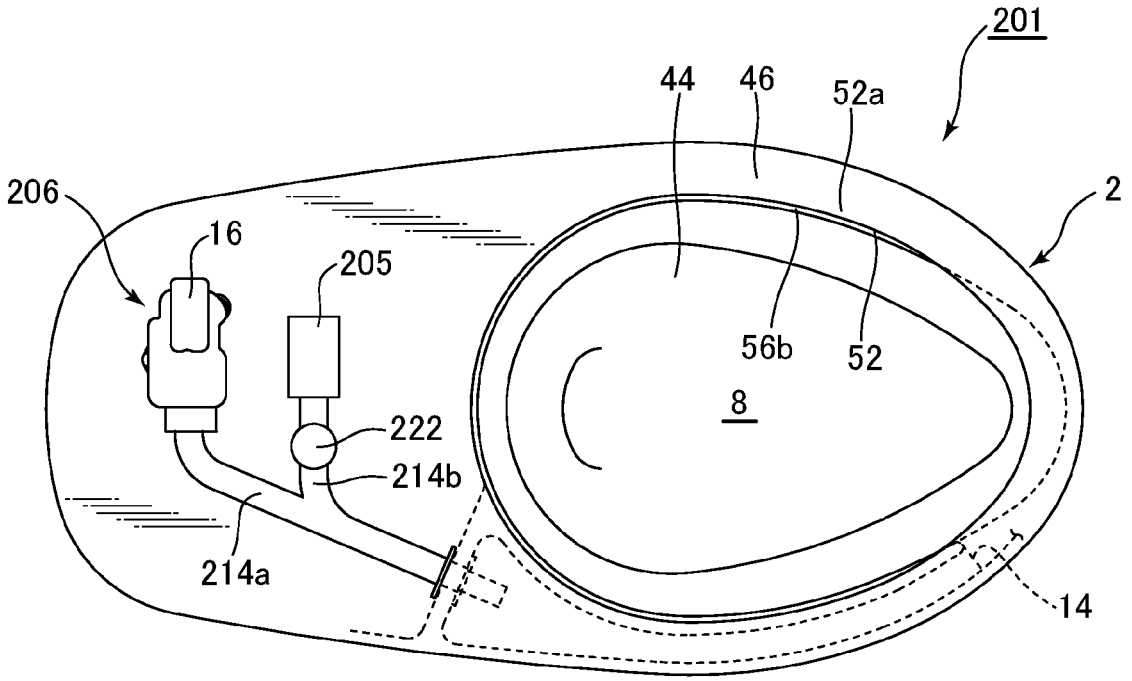
FIG. 10 is a summary plan view showing part of the cover and water supply apparatus removed in a flush toilet according to a third embodiment of the invention.

Next, referring to FIG. 10, we explain a flush toilet according to a third embodiment of the invention. Whereas in the hybrid water supply apparatus 6 according to a first embodiment of the invention, water for rim spouting had been supplied using utility water pressure, in the hybrid water supply apparatus 206 according to a third embodiment of the invention, in addition to the first water supply system of the water supply apparatus 6 according to the first embodiment of the invention, a water supply apparatus is applied to the flush toilet to which a second water supply system is added in parallel for storing flush water from a water source in a flush water tank (not shown), and supplying the flush water in this flush water tank using supply pressure added to (supplemented by) a water supply pressurizing pump 205.

FIG. 10 is a summary plan view showing a part of the cover and water supply apparatus removed in a flush toilet according to a third embodiment of the invention. The flush toilet according to the third embodiment has essentially the same structure as the above-described flush toilet according to the first embodiment and flush toilet according to the second embodiment, therefore we will explain parts of the third embodiment different from the first embodiment and the second embodiment.

As shown in FIG. 10, a flush toilet 201 according to a third embodiment comprises a water supply apparatus 206 disposed at the back of the toilet main unit 2. In the hybrid water supply apparatus 206 on the flush toilet 201, flush water flowing in from water sources such as utilities, etc. is branched after passing through a stop cock 40*a* or the like. One of the branched flow paths is connected to a first rim spout water supply system 214*a* leading to the rim spout port 14 through the constant flow rate valve 16, as shown in the first embodiment of the invention, whereby water is supplied by direct pressure from a utility, etc.; the other branched flow path is connected to a second rim spout water supply system 214*b* for storing flush water in a flush water tank (not shown) and causing the flush water in this flush water tank to be spouted from the rim spout port 14 using supply pressure pressurized (supplemented) by a water supply pressurizing pump 205.

In the first water supply system 214*a*, the hybrid water supply apparatus 206 has a constant flow rate valve 16 and an electromagnetic valve 18 for restraining the flow rate of flush water supplied from the water source to a predetermined flow rate (instantaneous flow rate) or below.

The second water supply system 214*b* has a flush water tank for storing flush water supplied from a utility or other water source, a water supply pressurizing pump 205 capable of pressurizing flush water in the flush water tank (flush water supplied from the flush water tank) up to a water pressure in a predetermined range, and a reverse-flow preventing check valve (flapper valve for rim spouting, etc.) 222.

The first water supply system 214*a* and second water supply system 214*b* are formed in parallel, and are merged before reaching the rim spout port 14. Hence in the hybrid water supply apparatus 206 a predetermined flow rate of water can be rim spouted through either the first water supply system 214*a* or the second water supply system 214*b*.

The water supply pressurizing pump 205 can pressurize flush water and feed it at a predetermined flow rate (instantaneous flow rate) or greater, and can control the degree of pressurization to feed the flush water while controlling it to a predetermined flow rate (instantaneous flow rate) or below. In the present embodiment this water supply pressurizing pump 205 limits the flush water flow rate (instantaneous flow rate) to 16 liters/minute or below, for example. Thus the water supply pressurizing pump 205 is able to control the flush water flow rate to a predetermined instantaneous flow rate or below, and is able to maintain the flush water flow rate at a predetermined instantaneous flow rate. Therefore if the flush water instantaneous flow rate fluctuates, the water supply pressurizing pump 205 can maintain the flow rate of flush water supplied within a range at or above a predetermined instantaneous flow rate and at or below a predetermined instantaneous flow rate.

As in the flush toilet 1 according to the first embodiment, in a toilet 201 according to a third embodiment of the invention, as well, the rim inside wall portion 52 comprises a rim inside wall upper sloped surface 52*a* wherein the inside of the upper region of the rim inside wall portion 52 slopes downward, so that in a flush toilet 201 in which an effort is made to improve user visibility so that the upper portion of the waste receiving surface 44 is perceived to widen outward, and to improve rim portion 46 cleanability, a rim inside wall upper sloped surface 52*a* is formed in which the inside of the rim inside wall portion 52 upper region slopes downward, therefore the height of the inside surface 52*b* vertically extending straight to rim inside wall upper sloped surface 52*a* is formed to have a relatively low height.

Therefore even when the height of the inside surface 52*b* is formed to be relatively low, the constant flow rate valve 16 can maintain a constant flush water instantaneous flow rate spouted from the rim spout port 14, or the hybrid water supply apparatus 206 water supply pressurizing pump 205 can cause a predetermined constant flow rate of flush water to be spouted from the rim spout port 14, so that flush water can be constrained from traveling by centrifugal force along the rim inside wall upper sloped surface 52*a* from the inside surface 52*b* formed at a relatively low height and splashing to the outside of the bowl portion 8.

What is claimed is:

1. A flush toilet comprising:

a bowl portion including a bowl-shaped waste receiving surface and a rim portion formed on a top edge of the waste receiving surface;

a discharge path configured to discharge waste, the discharge path has an inlet that is connected at a bottom of the bowl portion;

a spout portion configured to generate a circulating current by spouting flush water to the bowl portion;

a water conduit configured to supply flush water to the water spout portion; and a water supply apparatus configured to supply flush water to the water conduit;

wherein the rim portion comprises a rim inside wall portion forming an inner perimeter of the rim portion, and the rim inside wall portion comprises a rim inside wall upper sloped surface and an inner side surface, the rim inside wall upper sloped surface being positioned on a top region of the rim inside wall portion and being sloped downward toward the inner side surface, the inner side surface in a vertical cross section being formed in a straight line which is sloped toward an outside of the bowl portion up to the rim inside wall upper sloped surface; and wherein the water supply apparatus comprises a constant flow rate device for spouting a constant flow rate of flush water from the water spout portion.

2. The flush toilet of claim 1, wherein the rim portion comprises a rim top surface portion forming a top surface on the rim portion, and a rim outside wall portion forming an outer perimeter of the rim portion;

the rim outside wall portion comprises a rim outside wall upper sloped surface in which an outside of the rim outside wall portion upper region is sloped downward; and the horizontal distance between the upper end of the rim inside wall upper sloped surface and the lower end of the rim inside wall upper sloped surface is longer than the horizontal distance between the upper end of the rim outside wall upper sloped surface and the lower end of the rim outside wall upper sloped surface.

3. The flush toilet of claim 1, wherein the rim inside wall upper sloped surface is formed in an arc shape.

4. The flush toilet of claim 1, wherein a bottom edge of the rim inside wall upper sloped surface is disposed above a top edge of the water spout portion.

5. The flush toilet of claim 3, wherein the rim outside wall upper sloped surface is formed in an arc shape, and furthermore a ratio between the radius of the arc forming the rim outside wall upper sloped surface and the radius of the arc forming the rim inside wall upper sloped surface is formed to be within a ratio range of 1:2 to 1:5.

6. The flush toilet of claim 1, wherein the rim inside wall upper sloped surface is formed such that the vertical distance between the upper end of the rim inside wall upper sloped surface and the lower end of the rim inside wall upper sloped surface is 10% to 60% of the vertical distance between the upper end of the rim inside wall portion and the lower end of the rim inside wall portion.

7. The flush toilet of claim 3, wherein the rim inside wall upper sloped surface is configured to have an arc whose radius is between 10 mm and 30 mm inclusive.

8. The flush toilet of claim 1, wherein the constant flow rate device comprises a constant flow rate valve.

9. The flush toilet of claim 1, wherein the constant flow rate device comprises a pump.

* * * * *